US009611781B2

(12) United States Patent
Moscherosch et al.

(10) Patent No.: US 9,611,781 B2
(45) Date of Patent: Apr. 4, 2017

(54) SYSTEM AND METHOD OF THERMAL MANAGEMENT FOR AN ENGINE

(71) Applicant: GM GLOBAL TECHNOLOGY OPERATIONS LLC, Detroit, MI (US)

(72) Inventors: Ben W. Moscherosch, Forest Lake, MN (US); Akram R. Zahdeh, Rochester Hills, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 306 days.

(21) Appl. No.: 14/593,414

(22) Filed: Jan. 9, 2015

(65) Prior Publication Data

US 2016/0201548 A1 Jul. 14, 2016

(51) Int. Cl.

| | |
|---|---|
| ***F01P 7/00*** | (2006.01) |
| ***F01P 7/16*** | (2006.01) |
| ***F01P 3/02*** | (2006.01) |

(52) U.S. Cl.

CPC ..... *F01P 7/164* (2013.01); *F01P 3/02* (2013.01); *F01P 7/162* (2013.01); *F01P 2003/024* (2013.01); *F01P 2025/64* (2013.01); *F01P 2037/00* (2013.01)

(58) Field of Classification Search

CPC .... F01P 7/164; F01P 7/162; F01P 7/14; F01P 7/00; F01P 3/02; F01P 2003/024; F01P 2003/027; F01P 2025/08; F01P 2025/64; F01P 2037/00

USPC ..... 123/41.02, 41.44

See application file for complete search history.

(56) References Cited

U.S. PATENT DOCUMENTS

| | | | | |
|---|---|---|---|---|
| 6,247,429 | B1 * | 6/2001 | Hara | F01P 5/10 123/41.1 |
| 8,893,668 | B2 * | 11/2014 | Jo | F01P 7/162 123/41.14 |
| 8,958,933 | B2 * | 2/2015 | Abihana | B60W 10/06 701/22 |
| 9,188,050 | B2 * | 11/2015 | Naito | F01P 3/12 |
| 2013/0305708 | A1 | 11/2013 | Zahdeh et al. | |

* cited by examiner

*Primary Examiner* — Grant Moubry
(74) *Attorney, Agent, or Firm* — Quinn IP Law

(57) ABSTRACT

A system and method of thermal management for an engine are provided. The system includes an engine, an electrical water pump, and a controller. The controller has a processor and tangible, non-transitory memory on which is recorded instructions. Executing the recorded instructions causes the processor to continuously monitor the temperature of the cylinder head and the temperature of the coolant. If the monitored temperatures of the cylinder head and the coolant are below predetermined thresholds, the processor executes a first control action, in which the pump remains off and the coolant remains stagnant. If either of the monitored temperatures of the cylinder head or coolant reaches the respective predetermined threshold, the controller initiates a second control action, which requires the controller to signal the pump to turn on and circulate coolant. The controller then determines the desired operating speed of the electrical water pump based on engine load.

20 Claims, 3 Drawing Sheets

SYSTEM AND METHOD OF THERMAL MANAGEMENT FOR AN ENGINE

TECHNICAL FIELD

The present teachings relate to a system and method of thermal management for a vehicle having an engine and an electrical water pump.

BACKGROUND

In a conventional thermal management system for an engine, a cooling circuit circulates a coolant liquid, generally of water and antifreeze. The cooling circuit generally includes a coolant pump, which propels the coolant liquid through the cooling circuit. Engine thermal management systems are generally designed to promote engine and coolant liquid warm-up after cold start and to promote engine cooling during normal vehicle operation.

SUMMARY

A system and method of thermal management for an engine are provided. The engine thermal management system may include an engine, an electrical water pump, an engine water jacket, and a controller.

The engine may include an engine block and a cylinder head. The engine water jacket may include each of an engine block cooling jacket, a lower head cooling jacket, and an upper head cooling jacket. The engine water jacket may receive coolant from the electrical water pump, which is configured to circulate coolant throughout the thermal management system.

The controller has a processor and tangible, non-transitory memory on which is recorded instructions. Executing the recorded instructions causes the processor to effectuate the method of thermal management for an engine of the present disclosure. The controller may be configured to execute the present method via the following steps. The controller may continuously monitor, via a temperature sensor, each of the temperature of the cylinder head and the temperature of the coolant. If the monitored temperature of the cylinder head is below a predetermined cylinder head temperature threshold and the monitored temperature of the coolant is below a predetermined coolant temperature threshold then the controller will execute a first control action, such that the controller repeatedly compares the monitored temperature of the cylinder head to the predetermined cylinder head temperature threshold and repeatedly compares the monitored temperature of the coolant to the predetermined coolant temperature threshold until one or more of the following is true: 1) the monitored temperature of the cylinder head reaches the predetermined cylinder head temperature threshold; and 2) the monitored temperature of the coolant reaches the predetermined coolant temperature threshold.

When either one or both of the monitored temperature of the cylinder head reaches the predetermined cylinder head temperature threshold or the monitored temperature of the coolant reaches the predetermined coolant temperature threshold, the controller initiates a second control action, such that the controller signals the electrical water pump to turn-on and circulate coolant to control the temperature of the engine. The controller then determines the desired operating speed of the electrical water pump based on the engine load to maximize fuel economy and reduce electrical water pump work.

The above features and advantages, and other features and advantages, of the present teachings are readily apparent from the following detailed description of some of the best modes and other embodiments for carrying out the present teachings, as defined in the appended claims, when taken in connection with the accompanying drawings.

DETAILED DESCRIPTION

The following description and Figures refer to example embodiments and are merely illustrative in nature and not intended to limit the disclosure, its application, or uses. Referring to the Figures, wherein like reference numbers correspond to like or similar components throughout the several views, an engine thermal management system 10 and a method 100 for controlling the same are provided.

Figure 1:
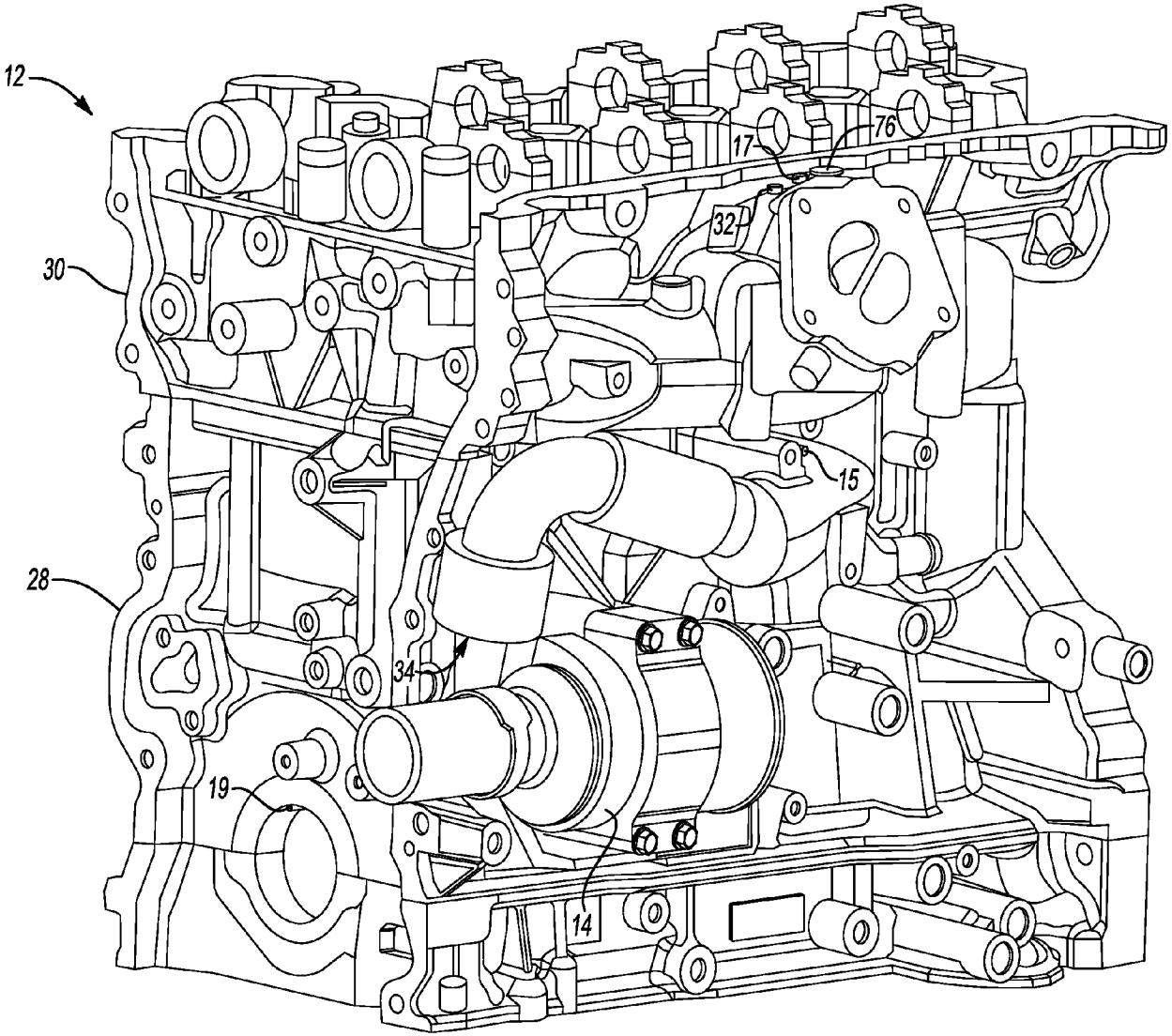
FIG. 1 is a schematic perspective view of an example engine with an electrical water pump integrated therewith.
Figure 2:
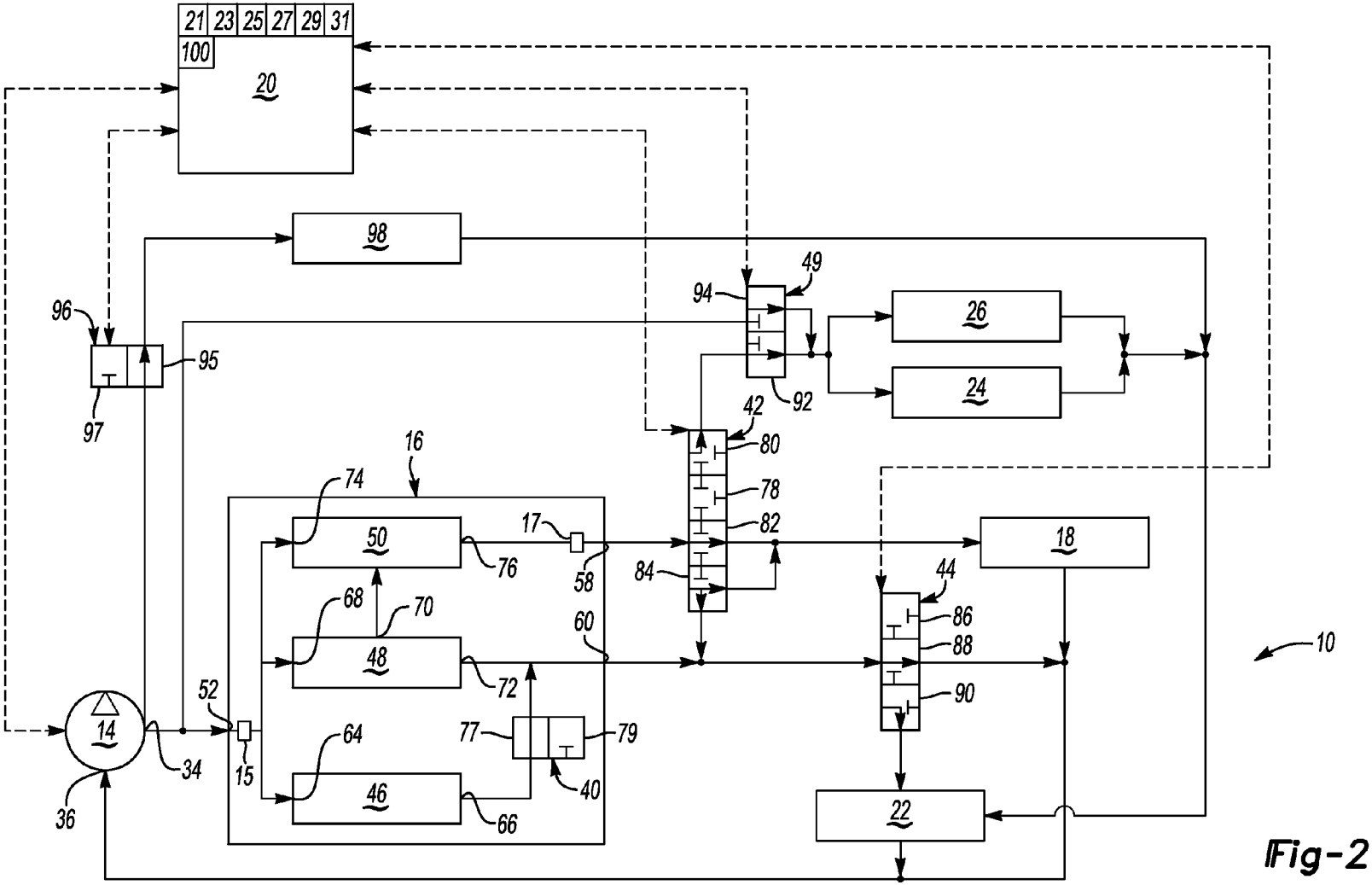
FIG. 2 is a schematic circuit diagram of an example embodiment of the engine thermal management system.

Referring to FIGS. 1 and 2 the engine thermal management system 10 may include at least an engine 12, an electrical water pump 14, an engine water jacket 16, a heater core 18, a radiator 22, a transmission heat exchanger 24, an engine oil heat exchanger 26, a plurality of flow control valves 40, 42, 44, and a controller 20.

Referring to FIG. 1 the engine 12 may include an engine block 28 and a cylinder head 30. As an illustrative example, the engine 12 may be a naturally aspirated engine with an integrated exhaust manifold or any configuration of a turbocharged engine. The engine cylinder head 30 may be formed of a first material. The first material may a suitable metallic material, such as Aluminum. The system 10 may further include an engine temperature sensor 32, disposed within the cylinder head 30, configured to monitor the temperature of the first material composing the cylinder head 30.

The electrical coolant pump 14 may be coupled to the engine block 28 and configured to circulate a coolant though the system 10. The electric coolant pump 14 is an electrical coolant pump 14 controlled by the controller 20, and provides coolant independent of the operating speed of the engine 12. Because the electrical coolant pump 14 is decoupled from the engine speed, the controller 20 may control the speed at which the electrical coolant pump 14 operates and the flow of coolant, and tailor the electrical water pump 14 speed and coolant flow based on engine load. The controller 20 may further control the flow and distribution of the coolant throughout the thermal management system via the actuation of the plurality of flow control valves 40, 42, 44, 49 and may selectively distribute coolant throughout the thermal management system 10 as well as hold the coolant stagnant, with the electrical coolant pump 14 turned off, for maximum engine 12 and/or coolant warm-up. The electrical coolant pump 14 may include a coolant pump outlet 34 and a coolant pump inlet 36. The electrical coolant pump 14 may be configured to circulate the coolant through the engine thermal management system 10.

Referring to FIG. 2, the engine thermal management system 10 may further include the engine water jacket 16, the heater core 18, the radiator 22, the engine oil heat exchanger 26, the transmission heat exchanger 24, a turbo charger cooler 98, and a plurality of flow control valves 40, 42, 44, 49. The engine water jacket 16 may have at least one water jacket coolant inlet 52 and at least one water jacket coolant outlet 58, 60. The engine water jacket 16 is configured to receive coolant from the electrical coolant pump 14 at the at least one water jacket coolant inlet 52 and further configured to expel coolant from the at least one water jacket coolant outlet 58, 60. The engine water jacket 16 may include an engine block cooling jacket 46, a lower head cooling jacket 48, and an upper head cooling jacket 50. The coolant expelled from the at least one water jacket coolant outlet 58, 60 is selectively distributed throughout the thermal management system 10, by the controller 20 via the actuation of the plurality of flow control valves 40, 42, 44, 49 and at least one on/off valve 96 and subsequently routed to one of the heater core 18, the engine oil heat exchanger 26, the transmission heat exchanger 24, and the radiator 22.

The engine block cooling jacket 46 may include an engine block cooling jacket inlet 64, engine block coolant passages (not shown), and an engine block cooling jacket outlet 66. The engine block cooling jacket 46 is configured to expel coolant to one of the plurality of flow control valves 40.

The lower head cooling jacket 48 may include a lower head cooling jacket inlet 68, lower head coolant passages (not shown), and a plurality of transfer ports 70, which transfer coolant from the lower head cooling jacket 48 to the upper head cooling jacket 50. The lower head cooling jacket 48 may also include at least one lower head cooling jacket outlet 72. The lower head cooling jacket 48 is configured to expel coolant to one of the upper head cooling jacket 50 directly via the transfer ports 70 and one of the plurality of flow control valves 44, which dependent upon the actuation position thereof routes coolant to one of the radiator 22 and the electrical coolant pump 14.

The upper head cooling jacket 50 may include at least one upper head cooling jacket inlet 74, an upper head cooling jacket outlet 76, and upper head jacket coolant passages (not shown). The coolant flowing through the upper head cooling jacket 50 is expelled from the upper head cooling jacket outlet 76 and selectively routed by the controller 20 to one of the heater core 18 to aid in the warming of a vehicle passenger compartment, the engine oil heat exchanger 26 to aid in moderating the temperature of the engine oil, the transmission heat exchanger 24 to aid in moderating the temperature of the transmission, and the radiator 22 to aid in cooling the engine 12 via the plurality of flow control valves 40, 42, 44, 49 as described herein below.

The engine thermal system 10 may further include the plurality of flow control valves 40, 42, 44, 49 which may be actuated by the controller 20 and configured to occupy selected actuation positions in order to selectively distribute flow of the coolant expelled from the electrical coolant pump 14 to at least one of the heater core 18, the engine oil heat exchanger 26, the transmission heat exchanger 24, and the radiator 22.

The plurality of flow control valves 40, 42, 44, 49 may be configured to receive coolant from at least one of the coolant pump 14, the engine block cooling jacket 46, the lower head cooling jacket 48, and the upper head cooling jacket 50. The plurality of flow control valves includes at least a first flow control valve 40, a second flow control valve 42, a third flow control valve 44, and a mode selection valve 49. The first flow control valve 40 is configured to receive coolant from the engine block cooling jacket 46 via the engine block cooling jacket outlet 66. The first flow control valve 40 is further configured to occupy one of an open position 77 and a closed position 79. The first flow control valve 40 may be any conventional, multi-port, two-position valve.

The second flow control valve 42 is configured to receive coolant from the upper head cooling jacket 50. The second flow control valve 42 may be any conventional, multi-port, four-position valve. The second flow control valve 42 is actuated by the controller 20 to occupy one of a first position 78, a second position 80, a third position 82, and a fourth position 84. The upper head cooling jacket 50, dependent upon the actuated determinant position of the second flow control valve 42, expels coolant to one of the heater core 18, the engine oil heat exchanger 26, and the transmission heat exchanger 24, via the mode selection valve 49, and the third flow control valve 44. The second flow control valve 42 is fully closed in the first position 78, expels coolant to the engine oil heat exchanger 26 and the transmission heat exchanger 24 via the mode selection valve 49 in the second position 80, expels coolant to the heater core 18 in the third position 82, and expels coolant to the heater core 18 and the radiator 22, via the third flow control valve 44, in the fourth position 84.

The third flow control valve 44 is configured to receive coolant from each of the lower head cooling jacket 48, the first flow control valve 40, and the second flow control valve 42. The third flow control valve 44 may be any conventional, multi-port, three-position valve. The third flow control valve 44 is actuated by the controller 20 to occupy one of a first position 86, a second position 88, and a third position 90. The third flow control valve 44 is fully closed in the first position 86, expels coolant to the electrical coolant pump 14 in the second position 88, and expels coolant to the radiator 22 in the third position 90.

The mode selection valve 49 is configured to receive coolant from one of the electrical coolant pump 14 and the second flow control valve 42. The mode selection valve 49 may be any conventional, multi-port, two-position valve. The mode selection valve 49 is further configured to occupy one of a first position 92 and a second position 94. When the engine oil and transmission require warming, the mode selection valve 49 occupies the first position 92 and receives warm coolant from the second flow control valve 42 and expels warm coolant to each of the engine oil heat exchanger 26 and the transmission heat exchanger 24 to facilitate the warming of each of the transmission and the engine oil.

When the engine oil and transmission require cooling, the mode selection valve 49 occupies the second position 94 and receives cold coolant directly from the electrical coolant pump 14 and expels cold coolant to each of the engine oil heat exchanger 26 and the transmission heat exchanger 24 to facilitate the cooling of each of the transmission and the engine oil.

The engine thermal management system 10 may also include at least one on/off valve 96. The at least one on/off valve 96 may be any conventional, multi-port, two-position valve. The at least one on/off valve 96 is configured to occupy one of an open position 95 and a closed position 97, such that in the open position the at least one on/off valve 96 receives cold coolant from the electrical coolant pump 14 and expels cold coolant to a turbocharger cooler 98. The turbocharger cooler 98 is configured to receive coolant from the at least one on/off valve 96, when the at least one on/off valve 96 occupies the open position 95. The turbocharger cooler 98 is configured to facilitate cooling of a turbocharger (not shown). The turbocharger cooler 98 is further configured to expel coolant to the radiator 22.

Referring to the controller 20 generally shown in FIG. 2, the controller 20 includes a processor and tangible, non-transitory memory on which is recorded instructions. Executing the recorded instructions causes the processor to effectuate the present method 100, described herein below with respect to FIGS. 3-7. The controller 20 may be a stand-alone unit, or be part of an electronic controller that controls the operation of the engine thermal management system 10. The controller 20 may be embodied as a server/host machine or distributed system, e.g., a digital computer or microcomputer, acting as a vehicle control module, and/or as a proportional-integral-derivative (PID) controller device having a processor, and tangible, non-transitory memory such as read-only memory (ROM) or flash memory. The controller 20 may also have random access memory (RAM), electrically erasable programmable read only memory (EEPROM), a high-speed clock, analog-to-digital (A/D) and/or digital-to-analog (D/A) circuitry, and any required input/output circuitry and associated devices, as well as any required signal conditioning and/or signal buffering circuitry.

In general, computing systems and/or devices, such as the controller 20, may employ any of a number of computer operating systems and generally include computer-executable instructions, where the instructions may be executable by one or more computing devices such as those listed above. Computer-executable instructions may be compiled or interpreted from computer programs created using a variety of well-known programming languages and/or technologies, including, without limitation, and either alone or in combination, Java™, C, C++, Visual Basic, Java Script, Perl, etc. In general, a processor (e.g., a microprocessor) receives instructions, e.g., from a memory, a computer-readable medium, etc., and executes these instructions, thereby performing one or more processes, including one or more of the processes described herein. Such instructions and other data may be stored and transmitted using a variety of known computer-readable media.

Therefore, the controller 20 can include all software, hardware, memory, algorithms, connections, sensors, etc., necessary to control and effectuate the operation of the engine thermal management system 10. As such, the controller 20 may be configured to monitor and control the engine thermal management process in a variety of engine modes, namely a first mode, a second mode, and a third mode. The first mode may be a cold-start mode wherein the electrical water pump 14 remains off, the coolant remains stagnant, and the engine requires warm up. The second mode may be an engine warm-up mode, wherein the electrical water pump 14 is turned on, but the engine 12 and the passenger compartment of the vehicle still require warming, and resultantly coolant is routed back to the electrical coolant pump 14 rather than through the radiator 22. The third mode may be an engine cooling or normal vehicular operational mode, wherein the engine 12, transmission, engine oil, and turbocharger require cooling, and resultantly the controller 20 routes as much coolant as possible through the radiator 22.

The controller 20 may communicate with the electrical coolant pump 14 to control when the pump 14 remains off, when the pump 14 turns on, and the speed at which the electrical coolant pump 14 operates. The controller 20 may further be configured to control the operation of and actuate the plurality of flow control valves 40, 42, 44, 49 and the on/off valve 96 to a selected actuation position to direct and selectively distribute the flow of coolant throughout the engine thermal management system 10 and effectuate the method of thermal management described herein. Further, the controller 20 may also communicate with various other subsystems and sensors on the engine 12 such as the engine temperature sensor 32, the first coolant temperature sensor 15, the second coolant temperature sensor 17, the engine crankshaft sensor 19, and other subsystems and sensors on the engine 12.

As shown in FIGS. 1 and 2, the engine temperature sensor 32 may be integrated with the engine cylinder head 30. The engine temperature sensor 32 is configured to continuously monitor the temperature of the first material comprising the engine cylinder head 30 during all vehicle operational modes, namely the first mode, the second mode, and the third mode. The engine temperature sensor 32 may be further configured to return a monitored engine cylinder head temperature result to the controller 20.

The first coolant temperature sensor 15 may be disposed at the engine water jacket inlet 52. The first coolant temperature sensor 15 is configured to continuously monitor the temperature of the coolant as it enters the engine water jacket 16, during all vehicle operational modes, namely the first mode, the second mode, and the third mode. The first coolant temperature sensor 15 may be further configured to return monitored inlet coolant temperature result to the controller 20.

The second coolant temperature sensor 17 may be disposed at the at least one engine water jacket outlet 58. The second coolant temperature sensor 17 is configured to continuously monitor the temperature of the coolant as it is expelled from the engine water jacket 16, during all vehicle operational modes, namely the first mode, the second mode, and the third mode. The second coolant temperature sensor 17 may be further configured to return monitored outlet coolant temperature result to the controller 20. The controller 20 may receive the monitored inlet coolant temperature result and the monitored outlet coolant temperature result and calculate a delta coolant temperature value, defined as the difference between the monitored outlet coolant temperature result and the inlet coolant temperature result.

The engine crankshaft sensor 19 may be disposed on a crankshaft of the engine 12 and may be configured to monitor the operating speed of the engine 12. The crankshaft sensor may be further configured to return a monitored engine speed result to the controller 20.

The engine thermal management system 10 shown in FIGS. 1 and 2, is suited to function in a variety of automotive operational modes, namely, the first mode, the second mode, and the third mode. In order to more efficiently warm the engine 12, the engine oil, and the transmission, and the passenger compartment in the first mode and the second mode, and most efficiently cool the engine 12, the engine oil, the transmission, and the turbocharger in the third mode, it is desirable to effectuate a control strategy, which controls the operation of the electrical coolant pump 14, namely when the pump 14 remains off, when the pump 14 turns on, and at what speed the pump 14 operates. Such an engine thermal management strategy is detailed by the present method 100, in which recorded instructions are executed by the controller 20 causing the processor 21 therein to effectuate the steps of the method 100 detailed by FIGS. 3-7.

Figure 3:
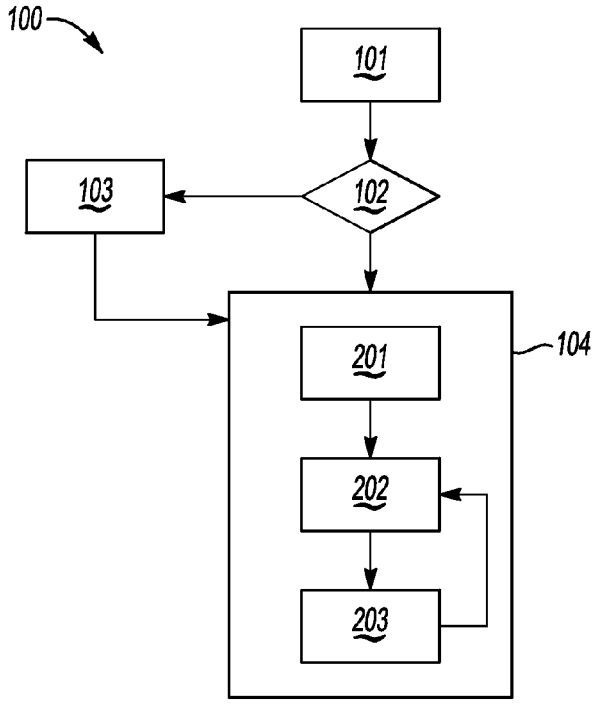
FIG. 3 is a flow diagram describing the steps of the present method of thermal management for an automotive engine with an electrical water pump.
Figure 4:
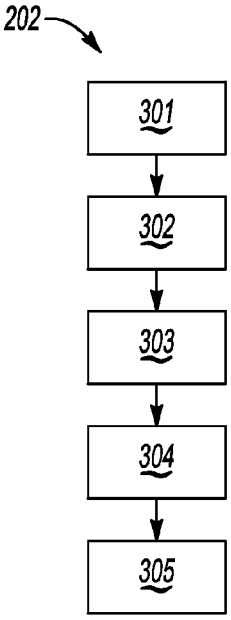
FIG. 4 is a flow diagram further detailing the step of determining the desired speed of the electrical water pump.
Figure 5:
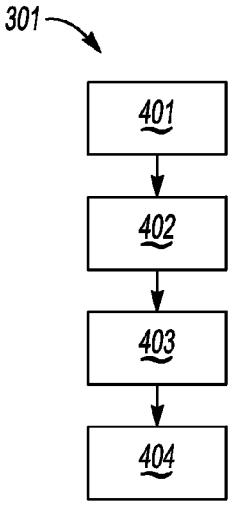
FIG. 5 is a flow diagram further detailing the step of determining an engine power of the engine.
Figure 6:
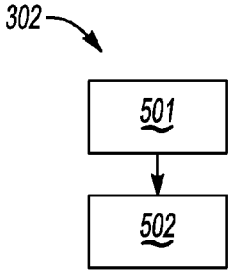
FIG. 6 is a flow diagram further detailing the step of determining an absolute heat rejection for the engine.
Figure 7:
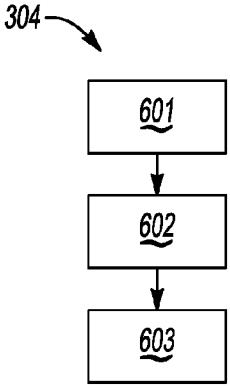
FIG. 7 is a flow diagram further detailing the step of determining a volumetric flow rate of the coolant.

Referring to FIG. 3, the engine 12 may begin in a first mode, wherein the engine is initially turned on at the start of an engine key cycle. When the engine 12 operates in the first mode, the controller 20 actuates the plurality of control valves 40, 42, 44, 49 to occupy a fully closed position, namely the first control valve 40 occupies the closed position 79, the second flow control valve 42 occupies the first position 78, the third flow control 44 control valve occupies a first position 86, and the mode selection valve 49 occupies the first position 92. The electrical water pump 14 remains off in the first mode holding the coolant stagnant. At this stage, the controller 20, as denoted by step 101 is configured to continuously monitor the temperature of the engine cylinder head 30 via the engine temperature sensor 32. As such, the engine temperature sensor 32 continuously monitors the temperature of the first material comprising the cylinder head 30 and returns a monitored engine cylinder head temperature result to the controller 20. Further, in step 101, the controller 20 simultaneously continuously monitors the temperature of the coolant via the second coolant temperature sensor 17. As such, the second coolant temperature sensor 17 returns a monitored outlet coolant temperature result to the controller 20.

At step 102, the controller 20 compares the monitored engine cylinder head temperature result to a predetermined cylinder head temperature threshold. The predetermined cylinder head temperature threshold may be the deformation temperature of the first material, which comprises the engine cylinder head 30. Further, at step 102 the controller 20 further simultaneously compares the monitored outlet coolant temperature result to a predetermined coolant temperature threshold. The predetermined coolant temperature threshold may be defined as the boiling point of the coolant.

If the monitored outlet coolant temperature result is below the predetermined cylinder head temperature threshold and the monitored outlet coolant temperature result is below the predetermined coolant temperature threshold, the controller 20 executes a first control action shown at step 103. At step 103, the electrical coolant pump 14 remains off and the thermal management system 10 remains in the first mode.

In executing the first control action, at step 103, the controller 20 executes two steps. First, the controller 20 repeatedly compares the monitored engine cylinder head temperature result to the predetermined cylinder head temperature threshold and the monitored outlet coolant temperature result to the predetermined coolant temperature threshold. If, during the repeated comparison, one or both of the of the monitored outlet coolant temperature result reaches or exceeds the predetermined cylinder head temperature threshold and the monitored outlet coolant temperature result meets or exceeds the predetermined coolant temperature threshold, the controller 20 initiates the second control action shown at step 104.

At step 104, the controller executes the second control action if one or both of the monitored outlet coolant temperature result reaches or exceeds the predetermined cylinder head temperature threshold and the monitored outlet coolant temperature result meets or exceeds the predetermined coolant temperature threshold. The initiation of the second control action is also the transition from the first mode to one of the second mode, i.e., engine warming, and the third mode, i.e., engine cooling. When initiating the second control action 104, the controller 20 initiates a second mode for the engine 12, wherein the electrical water pump 14 is signaled to turn on, the first flow control valve 40 is actuated to the open position 77, the second flow control valve 42 is actuated to one of the second position 80 and the third position 82, the third flow control valve is actuated to the second position 88, and the mode selection valve 49 is actuated to the first position 92. As such, the execution of the second control action causes the processor 21 and the controller 20, at step 201, to signal the electrical water pump 14 to turn on and begin circulating coolant.

In the second mode and the third mode, i.e., when the electrical water pump 14 is circulating coolant, the controller 20 actuates the plurality of flow control valves 40, 42, 44, 49 and the on/off valve 96 to predetermined positions to effectuate the thermal management strategy. More particularly, in the second mode, the engine 12 still requires warming, and as such, the controller 20 actuates the second flow control valve 42 to the second position 80. In the second mode, the first flow control valve 40 remains in the closed position and the third flow control valve 44 remains in the first position 86, in order to maintain initial heat-up of the engine block 28.

During the second mode, the engine block cooling jacket inlet 64 and the lower head jacket inlet 68 may be fixed open. However, because the first flow control valve 40 is fully closed, the coolant in the engine block jacket 46 remains stagnant to facilitate engine warm-up. The third flow control valve 44 is also actuated to the first or fully closed position 86, thereby routing all flow from the lower head cooling jacket 48 to the upper head cooling jacket 50. The second flow control valve 42 may be configured to receive all flow from the upper head cooling jacket 50, which is expelled from the upper head cooling jacket outlet 76 and the engine water jacket outlet 58.

Further, in the second mode the controller 20 selectively directs the heated coolant expelled from the upper head cooling jacket outlet 76 to the second flow control valve 42, such that the second flow control valve 42, while occupying the second position 80, directs coolant to the engine oil heat exchanger 26 and the transmission heat exchanger 24, respectively, via the at least one mode selection valve 49, which is actuated to the first position 92, to facilitate warming of the engine oil and the transmission respectively. The coolant may be used to heat the engine oil and heat the transmission to a suitable operating temperature, when routed from the second flow control valve 42, actuated to the second position 80, to the mode selection valve 49, occupying the first position 92, to thereby feed the engine oil heat exchanger 26 and the transmission heat exchanger 24. Pre-heating the engine oil and transmission can improve fuel economy and reduce friction.

Once the engine oil reaches a predetermined engine threshold operating temperature and the transmission reaches a predetermined threshold transmission operating temperature, the controller 20 actuates the second flow control valve to occupy the third position 82, thereby directing coolant to the heater core 18 to heat a passenger compartment. When the second flow control valve 42 occupies the third position 82, coolant is fed to the heater core 18 to facilitate warming of the passenger compartment to meet heating demand. However, in certain conditions, such as window defrost, heat must be provided to the passenger compartment, and, thus, coolant delivered to the heater core 18 prior to the engine oil and the transmission reaching the predetermined threshold temperature.

Once passenger compartment heating demand is met, the controller 20 actuates the first flow control valve 40 to occupy the open position 77, the second flow control valve to occupy the fourth position 84, thereby directing nearly all coolant from the second flow control valve 42 to the third flow control valve 44. However, a leakage path of the second flow control valve 42 is open to the heater core 18, allowing only the minimum amount of flow necessary to raise the dew point to be selectively distributed to the heater core 18. The second flow control valve 42 is actuated from the third position 82 to the fourth position 84 when the heating demand from the passenger compartment has been met, i.e. the passenger compartment reaches a predetermined temperature. In selectively directing and distributing the coolant the controller 20 actuates the third flow control valve 44 to occupy one of the second position 88 and the third position 90.

The controller 20 actuates the third flow control valve 44 to the second position 88, when the passenger compartment heating demand is met before the engine 12 reaches a its predetermined normal operating temperature, e.g., the engine thermal management system 10 remains in the second mode. When occupying the second position 88, the third flow control valve 44 directs warm coolant back to the electrical coolant pump 14 in order to continue to facilitate warming of the engine 12.

The controller 20 actuates the third flow control valve 44 to the third position 90, when the passenger compartment heating demand is met after the engine 14 reaches its predetermined normal operating temperature, e.g., the engine thermal management system 10 transitions to the third mode or an engine cooling mode. When occupying the third position 90, the third flow control valve 44 directs all coolant passing therethrough to the radiator 22 to facilitate cooling of the engine 12.

When the engine thermal management system 10, operates in the third mode or engine cooling mode, the objective of the engine thermal management system 10 is to route as much coolant flow through the radiator 32 as possible. During the third mode, the at least one on/off valve 96 is actuated to the open position 95 allowing coolant from the electrical coolant pump 14 to pass therethrough and on to the turbocharger cooler 98, to facilitate the cooling of a turbocharger. Further, during the third mode, the mode selection valve 49 is actuated to the second position 94 allowing cool coolant directly from the electrical coolant pump 14 to pass therethrough and on to the engine oil heat exchanger 26 and the transmission heat exchanger 24, to facilitate the cooling of the engine oil and transmission respectively.

After turning the electrical coolant pump on at step 201, the controller 20, at step 202, determines the desired speed at which the electrical water pump 14 is to operate based on the current load of the engine 12. Step 202, i.e., determining the desired speed of the electrical water pump 14, is further detailed in FIG. 4.

Determining the desired speed of the electrical water pump 14 requires several steps. First, the controller 20 determines the engine power of the engine 12. Determining the engine power is further detailed in FIG. 5. To determine the engine power of the engine 12, at step 401, the controller 20 first determines the operating speed of the engine 12. The engine speed may be monitored by a crankshaft sensor or engine speed sensor 19 (shown in FIG. 1) disposed on the engine crankshaft. The engine speed sensor 19 monitors the speed of the engine 12 and returns a monitored engine speed result to the controller 20.

At step 402, the controller 20 determines a desired air mass per cylinder value based on the monitored engine speed from a first look-up table 23 written on the tangible non-transitory memory of the controller 20. The first look-up table 23 is a one-dimensional look-up table containing a set of desired air mass per cylinder values, which correspond to a set of engine speed values. The controller 20 selects the desired air mass per cylinder value, which corresponds to the monitored engine speed result.

After determining a desired air mass per cylinder value at step 402, the controller 20 determines the maximum brake torque for the engine 12 at step 403. To determine the maximum brake torque for the engine 12 the controller 20 inputs the desired air mass per cylinder value determined at step 402 and the engine speed value determined at step 401 into a second look-up table 25, which is written on the tangible non-transitory memory of the controller 20. The second look-up table 25 is a two-dimensional look-up table containing a set of maximum brake torque values for the engine 12 based on engine speed and desired air mass per cylinder. The controller 20 selects the corresponding maximum brake torque valve from the second look-up table 25 that corresponds to the selected desire air mass per cylinder value selected at step 402 and the monitored engine speed result determined at step 401.

After determining the maximum brake torque of the engine 12 at step 403, the controller 20, at step 404, calculates the engine power based on the maximum brake torque value determined at step 403 and the monitored engine speed determined at step 401. The controller 20 multiplies the maximum brake torque value determined at step 404 and the engine speed determined at step 401 to calculate the engine power result.

Referring back to FIG. 4, after determining the engine power at step 301, the controller 20 determines the absolute heat rejection of the engine 12 at step 302. Determining the absolute heat rejection of the engine requires two steps, which are further detailed in FIG. 6. At step, 501 the controller 20 determines the brake specific heat rejection for the engine based on the engine speed result determined at step 401 and the desired air mass per cylinder determined at step 402. The controller 20 selects a brake specific heat rejection value from a third look-up table 27 written on the tangible non-transitory memory of the controller 20. The third look-up table 27 is a two-dimensional look-up table containing a set of brake specific heat rejection values for the engine 12 based on the engine speed and the desired air mass per cylinder. As such, the controller 20 selects the brake specific heat rejection value from the third look-up table 27, which corresponds to the monitored engine speed result determined at step 401 and the desired air mass per cylinder value determined at step 402.

At step 502, the controller 20 calculates the absolute heat rejection of the engine 12 based on the brake specific heat rejection determined at step 501 and the engine power calculated at step 301. The controller 20 multiplies the brake specific heat rejection determined at step 501 by the engine power determined at step 301 to produce the absolute heat rejection of the engine 12.

Referring back to FIG. 4, after determining the engine power at step 301 and calculating the absolute heat rejection at step 302, the controller 20 determines the desired coolant temperature delta between the water jacket coolant inlet 52 and the water jacket coolant outlet 58 at step 303. The coolant temperature delta between the water jacket coolant inlet 52 and the water jacket coolant outlet 58 is defined as the difference between the monitored outlet coolant temperature result returned to the controller 20 by the second temperature sensor 17 and the monitored inlet coolant temperature result returned to the controller 20 by the first temperature sensor 15. To determine the desired coolant temperature delta value between the water jacket coolant inlet 52 and the water jacket coolant outlet 58, the controller 20 selects a desired coolant temperature delta value based on the engine speed determined at step 401 and the desired air mass per cylinder determined at step 402 from a fourth look-up table 29 written on the tangible non-transitory memory of the controller 20. The fourth look-up table 29 is a two-dimensional look-up table containing a set of desired coolant temperature delta values for the engine based on the engine speed and the desired air mass per cylinder. The controller 20 selects the desired coolant temperature delta value from the fourth look-up table 29 that corresponds to the engine speed result determined at step 401 and the desired air mass per cylinder determined at step 402.

After determining the desired coolant temperature delta at step 303, the controller 20 calculates a desired volumetric flow rate of the coolant at step 304. Step 304 is further detailed in FIG. 7 and includes three steps. At step 601, the controller 20 multiplies the specific heat of the coolant liquid, which is written on the tangible non-transitory memory of the controller 20, by the desired coolant temperature delta value determined at step 303 to produce an evaluation element. At step 602, the controller 20 determines the desired mass flow rate of the coolant by dividing the absolute heat rejection of the engine 12 determined at step 302 by the evaluation element determined at step 601. At step 603, the controller calculates the desired volumetric flow rate based on the desired mass flow rate determined at step 602 and the density of the coolant, which is written on the tangible non-transitory memory of the controller 20. The controller 20 calculates the desired volumetric flow rate by dividing the desired mass flow rate of the coolant by the coolant density.

Referring back to FIG. 4, after determining the desired volumetric flow rate of the coolant at step 304, in step 305, the controller 20 selects a desired speed for the electrical water pump 14 based on the desired volumetric flow rate of the coolant calculated at step 304. At step 305, the controller 20 selects a desired speed for the electrical water pump 14 from a fifth look-up table 31 written on the tangible non-transitory memory of the controller 20. The fifth look-up table 31 is a one-dimensional look-up table containing a set of desired electrical water pump speed values, which correspond to a set of values representing the desired volumetric flow rate of the coolant. The controller 20 selects the electrical water pump 14 speed value that corresponds to the desired volumetric flow rate of the coolant determined at step 304.

Referring back to FIG. 3, after the controller 20 determines the desired speed of the electrical water pump 14 based on the current engine load, the controller 20, at step 203, adjusts the speed of the electrical water pump 14 to the desired speed calculated at step 202 by sending a signal to the electric water pump 14 and commanding the electrical water pump 14 to operate at the desired operation speed determined at step 202.

After adjusting the speed of the electrical water pump 14 to the desired speed at step 203, the controller 20 completes a closed loop and returns to step 202 to again determine the desired speed of the electrical water pump 14 based on the current engine load and repeats steps 202 and 203 in a closed loop until the controller 20 signals the electrical water pump 14 to turn-off.

The detailed description and the drawings or figures are supportive and descriptive of the present teachings, but the scope of the present teachings is defined solely by the claims. While some of the best modes and other embodiments for carrying out the present teachings have been described in detail, various alternative designs and embodiments exist for practicing the present teachings defined in the appended claims.

The invention claimed is:

1. An engine thermal management system for a vehicle comprising:

an engine having an engine block and an engine cylinder head;

an engine temperature sensor configured to monitor a temperature of the engine cylinder head;

an electrical water pump configured to circulate a coolant through the engine;

an engine water jacket having a coolant inlet and at least one coolant outlet, the engine water jacket configured to receive coolant from the electrical water pump at the coolant inlet;

a first coolant temperature sensor configured to monitor a temperature of the coolant at the coolant inlet and a second coolant temperature sensor configured to monitor a temperature of the coolant the at least one coolant outlet;

a controller having a processor and tangible, non-transitory memory on which is recorded instructions, wherein executing the recorded instructions causes the processor to:

repeatedly monitor the temperature of the cylinder head via the engine temperature sensor and repeatedly monitor the temperature of the coolant via the second coolant temperature sensor;

compare the monitored temperature of the cylinder head to a predetermined cylinder head temperature threshold and compare the monitored temperature of the coolant to a predetermined coolant temperature threshold; and execute one of a first control action and a second control action, such that the processor executes the first control action when the monitored temperature of the cylinder head is below the predetermined cylinder head temperature threshold and the monitored temperature of the coolant is below the predetermined coolant temperature threshold, and such that the processor executes the second control action when at least one of the temperature of the cylinder head exceeds the predetermined cylinder head temperature threshold and the temperature of the coolant exceeds the predetermined coolant temperature threshold, wherein:

the first control action includes repeatedly comparing the monitored temperature of the cylinder head to the predetermined cylinder head temperature threshold and repeatedly comparing the monitored temperature of the coolant to the predetermined coolant temperature threshold; and the second control action includes:

signaling the electrical water pump to turn-on and circulate coolant;

determining a desired speed of the electrical water pump; and adjusting a speed of the water pump to the desired speed.

2. The engine thermal management system of claim 1 wherein determining the desired speed of the electrical water pump further includes:

determining an engine power of the engine;

determining an absolute heat rejection of the engine;

determining a desired coolant temperature delta between the coolant inlet and the coolant outlet;

determining a volumetric flow rate of the coolant; and selecting a desired speed of the electrical water pump based on the determined volumetric flow rate of the coolant.

3. The engine thermal management system of claim 2 wherein determining the engine power further includes:

determining an engine speed via a crankshaft sensor;

selecting a desired air mass per cylinder from a first look-up table written on the tangible non-transitory memory of the controller, wherein the first look-up table is a one-dimensional look-up table containing a set of desired air mass per cylinder values which correspond to a set of engine speed values;

determining maximum brake torque for the engine from a second look-up table written on the tangible non-transitory memory of the controller, wherein the second look-up table is a two-dimensional look-up table containing a set of maximum brake torque values for the engine based on the engine speed and the desired air mass per cylinder; and calculating a determined engine power based on the determined maximum brake torque and the engine speed by multiplying the determined maximum brake torque by the determined engine speed.

4. The engine thermal management system of claim 3 wherein determining the absolute heat rejection of the engine further includes:

determining a brake specific heat rejection for the engine from a third look-up table written on the tangible non-transitory memory of the controller, wherein the third look-up table is a two-dimensional look-up table containing a set of brake specific heat rejection values for the engine based on the engine speed and the desired air mass per cylinder; and calculating a determined absolute heat rejection of the engine based on the determined brake specific heat rejection and the determined engine power by multiplying the determined brake specific heat rejection by the determined engine power.

5. The engine thermal management system of claim 4 wherein determining the desired coolant temperature delta between the coolant inlet and the coolant outlet includes selecting a desired coolant temperature delta from a fourth look-up table, written on the tangible non-transitory memory of the controller, wherein the fourth look-up table is a two-dimensional look-up table containing a set of desired coolant temperature delta values for the engine based on the engine speed and the desired air mass per cylinder.

6. The engine thermal management system of claim 5 wherein determining the volumetric flow rate of the coolant further includes:

multiplying the desired coolant temperature delta by a specific heat of the coolant to produce an evaluation element;

dividing the determined absolute heat rejection by the evaluation element to determine a mass flow rate of the coolant; and dividing the mass flow rate of the coolant by a coolant density.

7. The engine thermal management system of claim 6 wherein selecting the desired speed of the electrical water pump based on the determined volumetric flow rate of the coolant includes selecting the desired speed for the electrical water pump from a fifth look-up table written on the tangible non-transitory memory of the controller, wherein the fifth look-up table is a two-dimensional look-up table containing a set of desired speed values for the electrical water pump based on the volumetric flow rate of the coolant.

8. The engine thermal management system of claim 1 wherein the predetermined coolant temperature threshold is the boiling point of the coolant.

9. The engine thermal management system of claim 1 wherein the engine cylinder head is composed of a first material; and wherein the predetermined cylinder head temperature threshold is a deformation temperature of the first material.

10. The engine thermal management system of claim 1 further including:

a plurality of flow control valves configured to receive coolant from at least one of the coolant pump and the engine water jacket;

a heater core configured to receive coolant from at least one of the plurality of flow control valves;

a transmission heat exchanger configured to receive coolant from at least one of the coolant pump and the engine water jacket via at least one of the plurality of flow control valves;

an engine oil heat exchanger configured to receive coolant from at least one of the coolant pump and the engine water jacket via at least one of the plurality of flow control valves;

a radiator configured to receive coolant from at least one of the plurality of flow control valves, the transmission heat exchanger, and the engine oil heat exchanger; and wherein the controller is further configured to actuate the plurality of control valves to a selected actuation position and selectively distribute coolant to at least one of the heater core, the radiator, the transmission oil heat exchanger, and the engine oil heat exchanger based on the selected actuation position of the plurality of flow control valves.

11. The thermal management system of claim 10 wherein the engine water jacket includes:

an engine block cooling jacket and a lower head cooling jacket, each configured to receive coolant from the coolant pump; and an upper head cooling jacket configured to receive coolant from at least one of the coolant pump and the lower head cooling jacket.

12. The thermal management system of claim 11 wherein the plurality of flow control valves includes:

a first flow control valve configured to occupy one of an open position and a closed position, the first flow control valve further configured to receive coolant from the engine block cooling jacket;

a second flow control valve configured to occupy one of a first position, a second position, a third position, and a fourth position, such that the second flow control valve receives coolant from the upper head cooling jacket and expels warm coolant to each of the transmission heat exchanger and the engine oil heat exchanger when occupying the second position, expels coolant to the heater core when occupying the third position, and expels coolant to a third flow control valve when occupying the fourth position;

a mode selection valve configured to occupy one of a first position and a second position, such that when the mode selection valve occupies the first position the mode selection valve receives coolant from the second flow control valve and expels coolant to each of the transmission heat exchanger and the engine oil heat exchanger to facilitate the warming of each of the transmission and the engine oil, and such that when the mode selection valve occupies the second position the mode selection valve receives coolant from the coolant pump and expels coolant to each of the transmission heat exchanger and the engine oil heat exchanger to facilitate cooling of each of the transmission and the engine oil; and the third flow control valve configured to occupy one of a first position, a second position, and a third position, the third flow control valve further configured to receive coolant from one of the lower head cooling jacket, the first flow control valve, and the second flow control valve and further configured to expel coolant to the coolant pump when occupying the second position and to expel coolant to the radiator when occupying the third position.

13. The engine thermal management system of claim 12 wherein the engine thermal management system operates in a first mode, such that the controller actuates the first flow control valve to the closed position, the controller actuates the second flow control valve to occupy the first position, the controller actuates the third flow control valve to occupy the first position, and the mode selection valve occupies the first position, and an on/off valve occupies a closed position.

14. The engine thermal management system of claim 12 wherein the engine thermal management system operates in a second mode, such that the controller actuates the first flow control valve to occupy the closed position, the controller actuates the second flow control valve to occupy one of the second position and the third position, the controller actuates the third flow control valve to occupy the second position, and the controller actuates the mode selection valve to occupy the first position, and the controller actuates an on/off valve occupies a closed position.

15. The engine thermal management system of claim 12 wherein the engine thermal management system operates in a third mode, such that the controller actuates the first flow control valve to occupy the open position, the controller actuates the second flow control valve to occupy the fourth position, the controller actuates the third flow control valve to occupy the third position, and the mode selection valve occupies the second position, and an on/off valve occupies an open position.

16. A method of thermal management for an engine, the method comprising:

repeatedly monitoring a temperature of a cylinder head of the engine via an engine temperature sensor and repeatedly monitoring a temperature of the coolant via a coolant temperature sensor;

comparing, via a controller, the monitored temperature of the cylinder head to a predetermined cylinder head temperature threshold and comparing the monitored temperature of the coolant to a predetermined coolant temperature threshold;

executing, via the controller, one of a first control action and a second control action, such that the controller executes the first control action when the monitored temperature of the cylinder head is below the predetermined cylinder head temperature threshold and the monitored temperature of the coolant is below the predetermined coolant temperature threshold, and such that the controller executes the second control action when at least one of the monitored temperature of the cylinder head exceeds the predetermined cylinder head temperature threshold and the monitored temperature of the coolant exceeds the predetermined coolant temperature threshold, wherein:

the first control action includes repeatedly comparing, via the controller, the monitored temperature of the cylinder head to the predetermined cylinder head temperature threshold and repeatedly comparing the monitored temperature of the coolant to the predetermined coolant temperature threshold; and the second control action includes the steps of:

signaling, via the controller, the electrical water pump to turn-on and circulate coolant at a predetermined water pump speed;

determining, via the controller, a desired speed of the electrical water pump; and adjusting the predetermined water pump speed to the desired water pump speed.

17. The method of claim 16 wherein the engine cylinder head are composed of a first material, such that the predetermined cylinder head temperature threshold is a deformation temperature of the first material; and wherein the predetermined coolant temperature threshold is a boiling point of the coolant.

18. The method of claim 16 wherein determining the desired speed of the electrical water pump further includes:

determining the engine power of the engine;

determining the absolute heat rejection of the engine;

determining a coolant temperature delta between a coolant inlet and a coolant outlet;

determining a volumetric flow rate of the coolant; and selecting the desired speed of the electrical water pump based on the determined volumetric flow rate of the coolant.

19. The method of claim 18 wherein determining the engine power further includes:

determining an engine speed via an engine speed sensor;

determining a desired air mass per cylinder from a first look-up table written on the tangible non-transitory memory of the controller, wherein the first look-up table is a one-dimensional look-up table containing a set of desired air mass per cylinder values which correspond to a set of engine speed values;

determining maximum brake torque for the engine from a second look-up table written on the tangible non-transitory memory of the controller, wherein the second look-up table is a two-dimensional look-up table containing a set of maximum brake torque values for the engine based on the engine speed and the desired air mass per cylinder; and calculating the engine power based on the determined maximum brake torque and the engine speed by multiplying the determined maximum brake torque by the determined engine speed.

20. The method of claim 19 wherein:

determining the absolute heat rejection of the engine further includes:

determining a brake specific heat rejection for the engine from a third look-up table written on the tangible non-transitory memory of the controller, wherein the third look-up table is a two-dimensional look-up table containing a set of brake specific heat rejection values for the engine based on the engine speed and the desired air mass per cylinder; and calculating the absolute heat rejection of the engine based on the determined brake specific heat rejection and the determined engine power by multiplying the determined brake specific heat rejection by the determined engine power;

determining the coolant temperature delta between the coolant inlet and the coolant outlet further includes selecting a desired coolant temperature delta from a fourth look-up table, written on the tangible non-transitory memory of the controller, wherein the fourth look-up table is a two-dimensional look-up table containing a set of desired coolant temperature delta values for the engine based on the engine speed and the desired air mass per cylinder; and determining the volumetric flow rate of the coolant further includes:

multiplying the desired coolant temperature delta by a specific heat of the coolant to produce an evaluation element;

dividing the determined absolute heat rejection by the evaluation element to determine a desired mass flow rate of the coolant; and dividing the desired mass flow rate of the coolant by a coolant density.

* * * * *